US009689136B2

(12) United States Patent
Dinh et al.

(10) Patent No.: US 9,689,136 B2
(45) Date of Patent: Jun. 27, 2017

(54) METHOD AND APPARATUS FOR TESTING HELICAL PILES

(71) Applicant: Almita Piling Inc., Edmonton (CA)

(72) Inventors: Duc Dinh, Thong Nhat District (VN); Bien Dinh, Edmonton (CA)

(73) Assignee: Almita Piling Inc., Edmonton (CA)

( * ) Notice: Subject to any disclaimer, the term of this patent is extended or adjusted under 35 U.S.C. 154(b) by 91 days.

(21) Appl. No.: 14/717,207

(22) Filed: May 20, 2015

(65) Prior Publication Data

US 2016/0251819 A1 Sep. 1, 2016

Related U.S. Application Data

(60) Provisional application No. 62/126,252, filed on Feb. 27, 2015.

(51) Int. Cl.
*E02D 33/00* (2006.01)
*E02D 5/56* (2006.01)

(52) U.S. Cl.
CPC ..... *E02D 33/00* (2013.01); *E02D 5/56* (2013.01)

(58) Field of Classification Search
CPC .. E02D 33/00; E02D 1/08; E02D 5/56; E02D 7/22
See application file for complete search history.

(56) References Cited

U.S. PATENT DOCUMENTS 4,614,110 A 9/1986 Osterberg
5,576,494 A 11/1996 Osterberg
6,363,776 B1 * 4/2002 Reinert, Sr. ..... E02D 33/00 73/819
8,517,640 B2 8/2013 Kasprick et al.

* cited by examiner

*Primary Examiner* — Erika J Villaluna
(74) *Attorney, Agent, or Firm* — Marsh Fischmann & Breyfogle LLP; Jonathan A. Szumny

(57) ABSTRACT

A method and apparatus for static load-bearing capacity testing of helical piles is provided.

13 Claims, 8 Drawing Sheets

METHOD AND APPARATUS FOR TESTING HELICAL PILES

CROSS REFERENCES

This application claims priority to U.S. Patent Application No. 62/126,252 entitled "Method and Apparatus for Testing Helical Piles", filed Feb. 27, 2015, incorporated herein by reference in its entirety.

TECHNICAL FIELD

A method and apparatus for static load-bearing capacity testing of helical piles is provided.

BACKGROUND

Anchoring systems forming the foundations of buildings or other large structures are commonly used where adequate bearing capacity cannot be found to support the structural loads. Helical piles, which have a pile shaft with one or more spiral helical plates affixed thereto, can be rotated into the ground to support structures, providing a versatile and efficient alternative to conventional pile systems. It is well known that a pile's capacity is highly dependent upon the pile's configuration and the surrounding soil conditions, and that axial capacity of each pile in both tension and compression must be tested with significant accuracy prior to commencing construction of the supported structure. Such tests need to account for the impact of the number and size of plates upon the pile's capacity. Thus, there is a desire for precise and reliable apparatus and methodologies for testing load capacity of helical piles.

Conventional "top-down" load testing methods typically involve driving a test pile into the ground, incrementally applying pressure directly to the top of the pile (using a hydraulic jack or ram), and then measuring axial (e.g. upward and/or downward) movement of the pile. Conventional tests can be used to determine the maximum pressure required to pull the pile from the soil and the maximum load that can be supported by the pile without failure.

Some load testing methods incorporate the use of a "reaction pile system", which comprises the positioning of two "reaction piles" adjacent to the test pile, each reaction pile supporting a cross-beam braced against the test pile to monitor the pressure supplied by the jack and the associated displacement of the test pile.

Conventional "top-down" testing systems, however, require substantial loads to be applied to the test the piles (e.g., thousands of tonnes), resulting in extremely dangerous, costly, and time-consuming testing procedures. Further, at least two separate tests must be performed to determine the upward resistance and end-bearing capacity for each test pile.

U.S. Pat. Nos. 4,614,110 and 5,576,494 describe the Osterberg Cell®, or O-cell®, which is a load-generating cell designed to reduce the loads required in load capacity testing. The O-cell® is a hydraulically-driven cell installed at or near the bottom of drilled shafts, bored piles, driven piles, or other similarly constructed pile foundations. When the cell is pressurized, it generates loads bi-directionally along the shaft of the pile, that is—it expands to simultaneously apply force both upwardly and downwardly. The upward "pullout" force from the top of the cell is resisted by the shaft of the pile (i.e. providing the "skin-friction") and the downward force from the bottom of the cell is resisted by the interaction between the soil and the pile (i.e. determining the "end-bearing capacity" or "resistance"). Because the O-cell® is irretrievably instrumented into the shaft of the pile, however, each cell must be sacrificed and cannot be reused. Further, because of its positioning within the pile shaft, the overall strength of the pile shaft is reduced, preventing it from withstanding the higher torque necessary to rotate the piles into the soil. As such, the O-cell® is not readily appropriate for use with helical piles.

U.S. Pat. No. 8,517,640 describes an expandable bi-directional static load capacity testing system that is adapted for use with helical piles. The system involves dividing the helical pile into shaft and "toe" sections, and positioning a jack-like apparatus (e.g. such as the O-cell®) between the shaft and toe sections, and positioning first and second helical plates above the jack-like apparatus. This system, however, still requires that the jack-like apparatus be sacrificed and that two separate tests must be performed to obtain accurate shaft resistance and end bearing capacity. Further, where multiple helices are desired, the system requires that at least two helices are positioned above and one below the O-cell®.

There is a need for an improved testing system that can more accurately determine the load capacity of helical piles, and particularly of helical piles having a plurality of helical plates. It is desired that such a testing system could provide accurate resistance and end-capacity information for each plate(s). It is further desired that much of the system could be salvaged for reuse.

SUMMARY

Embodiments of the present apparatus and methodologies may be used for testing the load capacity of helical piles having any size (e.g. area), shape (e.g. angle) or number of helical plates, and may provide the shaft resistance and end-bearing capacity measurements for the pile (e.g. taking into account each helical plate or "helix"). It is understood that the skin resistance and end-bearing capacity of helical test piles can depend upon the number and size (area) of the plates, thus impacting the total capacity of the pile.

Broadly speaking, an apparatus for testing the load capacity of a helical pile positioned in soil is provided wherein the helical pile is operably connected to a reaction system having a cross beam and at least two reaction piles positioned in the soil adjacent to the helical pile and the apparatus comprises a bi-directional load-generating device for simultaneously generating tensile and compressive load on the helical pile, the helical pile, having a shaft with an upper end and a lower end, at least one load-transferring pipe, positioned within the pile shaft, the load-transferring pipe having an upper end and a lower end, the lower end of the helical pile and the load-transferring pipe configured to provide a hub and Kelly-bar arrangement, wherein the tensile and compressive loads impart simultaneous upward forces to the pile and downward forces to the load-transferring pipe for determining the shaft resistance and end-bearing capacity of the pile.

Broadly speaking, a method of testing the load capacity of a helical pile is provided, the pile being operatively connected to a pile reaction system, and the method comprising providing a helical pile, having at least one helical plate, the pile comprising an inner load-transferring pipe telescopically received within an outer pile shaft, the lower end of the load-transferring pipe and pile adapted to provide a Kelly-bar coupled to a tubular hub, providing a load-generating device for producing a tensile load on the pile and a compressive load on the load-transferring pipe, and measuring the pile resistance and end-bearing capacity of the pile.

DESCRIPTION OF EMBODIMENTS

According to embodiments herein, apparatus and methodologies for testing load capacity of helical piles is provided. The present apparatus and methodologies aim to provide a more accurate determination of both pile shaft resistance (e.g. "skin-friction") and end-bearing capacity of helical test piles, particularly where the piles comprise multiple helical plates (i.e. "helices" or "bearing plates"). It is desired that the present system 100 provide an instrumented helical test pile with sufficient strength to withstand the rotational forces required to install the helical piles having a plurality of helical plates, such instrumentation being used to measure and determine the shaft resistance and end-bearing capacity. The present system will now be described having regard to the enclosed FIGS. 1-8.

By way of background, helical piles, also known as screw piles or screw anchors, are deep foundation elements that have circular steel plates pressed into a spiral shape with a uniform pitch around the pile shaft. Helical piles are well known and commonly used to transfer the load from the shaft into the surrounding soil. Helical piles are rotated or screwed into the soil at their "lead" or "toe" ends by the application of rotational forces, or torque, and/or axial downward forces.

It is known that the installation of helical piles can be assisted by the addition of one or more helices to each pile. As such, piles with multiple helices must be manufactured to withstand the torque, friction, and/or axial forces required to rotate the shaft into the ground. The materials used to manufacture helical piles (e.g. galvanized steel) is generally dictated by many factors including the required length of the pile shaft, the geographic location of the structure being built, the surrounding soil characteristics, the size and number of helical plates, and the anticipated load. Helixes are commonly attached to the pile shaft in such a manner as to allow the plates to displace the soil, rather than to excavate the soil. Helixes are commonly positioned along the pile shaft near the lead end being positioned in the ground.

Embodiments of the present apparatus and methodologies may be used to test the load capacity of helical piles having any size (e.g. area), shape (e.g. angle) or number of helical plates, and may provide the resistance and end-bearing capacity measurements for the pile (e.g. taking into account each helix). It is understood that the skin resistance and end-bearing capacity of helical test piles can depend upon the number and size (area) of bearing plates, thus impacting the total capacity of the pile.

Figure 1:
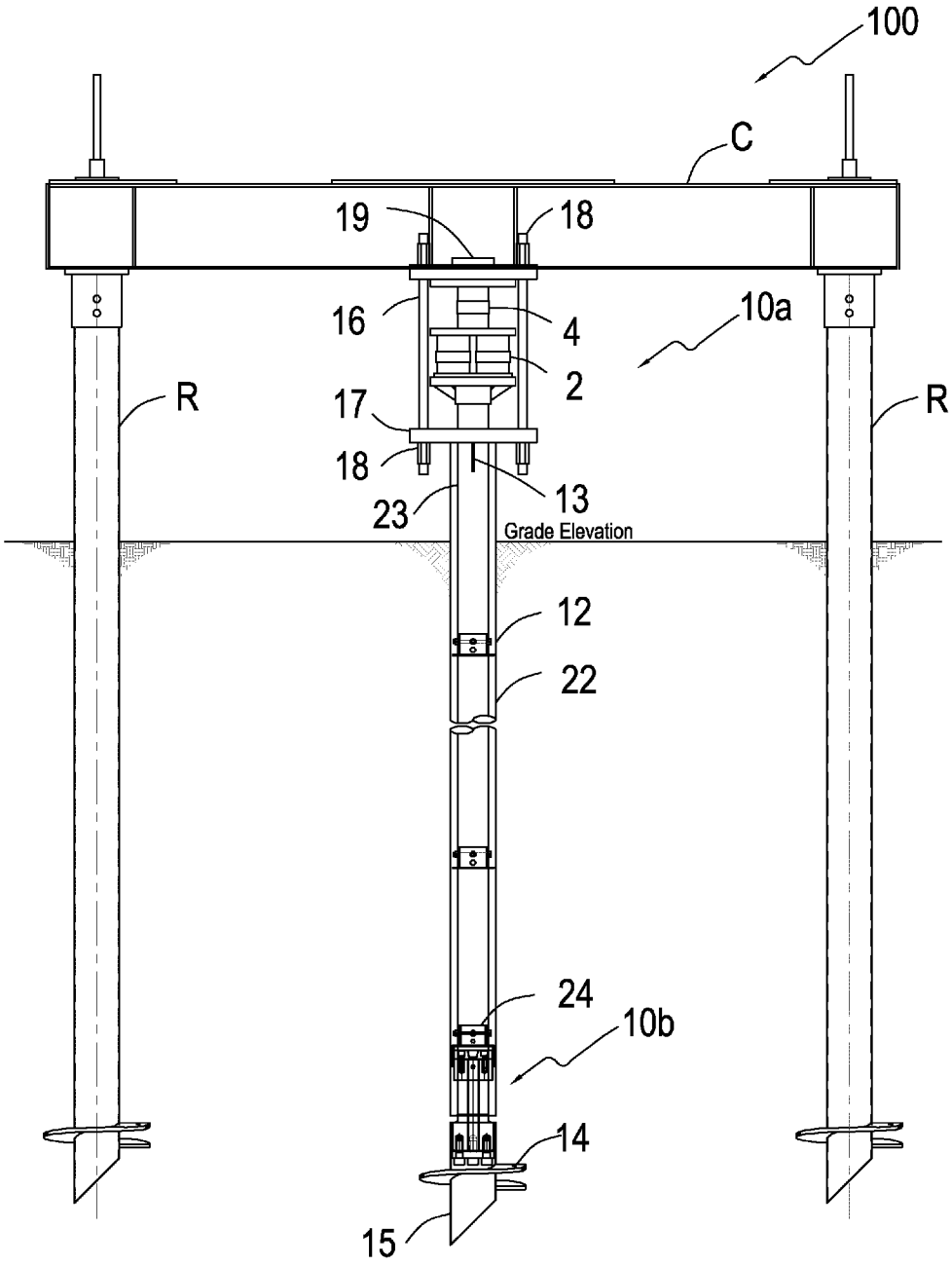
FIG. 1 is a side view of the present system according to embodiments herein where the helical test pile comprises a single helical plate or helix.
Figure 2:
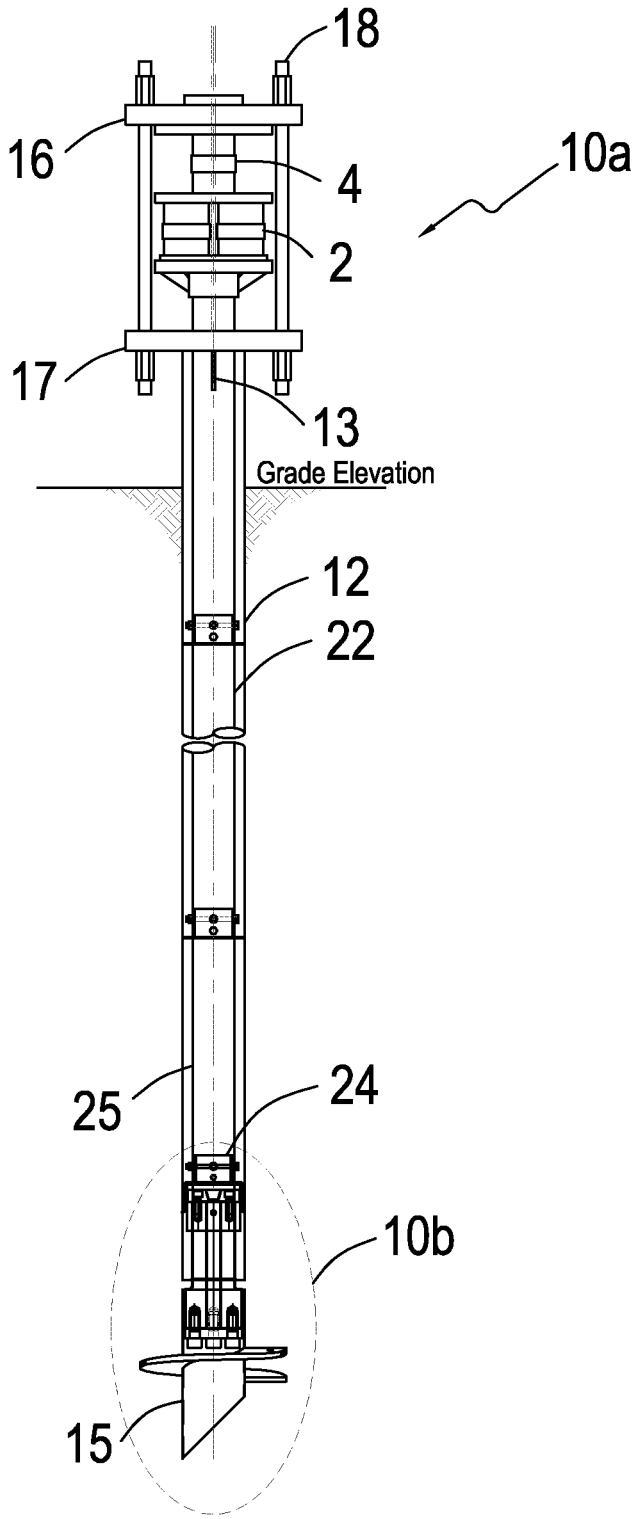
FIG. 2 is a side view of the helical test pile of the present system according to embodiments herein where the test pile comprises a single helix.

Having regard to FIG. 1, the present system 100 can be configured to combine two cooperative assemblies—a reusable drive assembly 10*a* positioned above ground, and a reusable load-testing assembly 10*b* positioned below the surface (that is—when the pile is removed from the ground after testing, the load-testing assembly 10*b* may subsequently be reutilized). The present system 100 may be used to test the load capacity of a helical test pile 12, the pile 12 having at least one helical plate 14, prior to commencing the construction of the structure. In some embodiments, the present system 100 is used to test the capacity of helical piles 12 having at least two helical plates 14 (see FIG. 3). In other embodiments, the present system 100 is used to test helical piles 12 having two or more helical plates.

It is an aspect of the present system 100 that the pile-driving assembly 10*a* is positioned above ground and configured such that the assembly components can be easily replaced or reused, thereby minimizing costs associated with prior art systems where, for example, testing components are sacrificed with each use. The pile-driving assembly 10*a* may be operative to generate and apply bi-directional, self-repulsive tensile and compressive forces to the pile 12, simultaneously determining the resistance/skin-friction and end-bearing capacity of the helical pile 12.

The present pile-driving assembly 10*a* may comprise a load-generating device 2 (e.g. a hydraulic jack) operative to expand a bi-directional load cell 4 capable of imparting both tension and compression loads to the helical test pile 12. It is one aspect of the present system 100 that the size and capacity of the load-generating device 2 and load cell 4 are not limited by the size (e.g. inner diameter) of the helical pile 12. It also an aspect of the present system 100 that the above ground pile-driving assembly 10*a* (e.g. jack, load cell, etc.) and reaction system may be recovered, recycled and reused.

As will be described in more detail below, the tensile forces generated by the load cell 4 serve to "pull" the test pile 12 from the ground, the upward forces being resisted by the peripheral surface of the test pile 12 against the surrounding soil. It is an aspect of the present assembly 100 that such "resistance" of the pile 12 can be measured using a reaction system having a cross bar "C" and at least two reaction piles "R". At the same time, the compressive forces generated by the load cell 4 serve to "push" the pile 12 into the ground, the downward forces being resisted by the at least one helical plates 14. It is an aspect of the present system 100 that such end-bearing capacity of the pile 12 can be measured by the load-testing assembly 10*b*.

Figure 3:
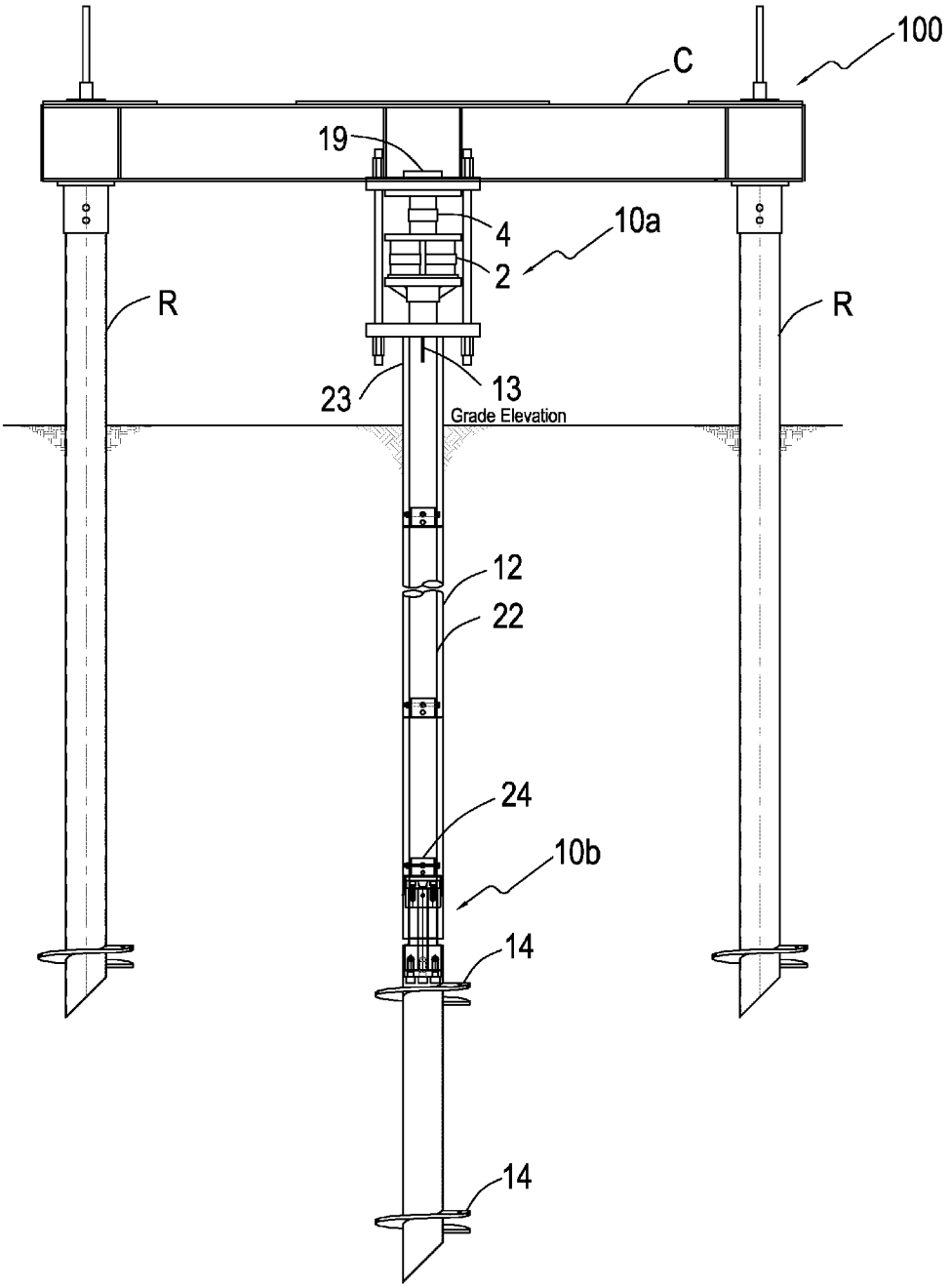
FIG. 3 is a side view of the present system according to embodiments herein where the helical test pile comprises more than one helix.
Figure 4:
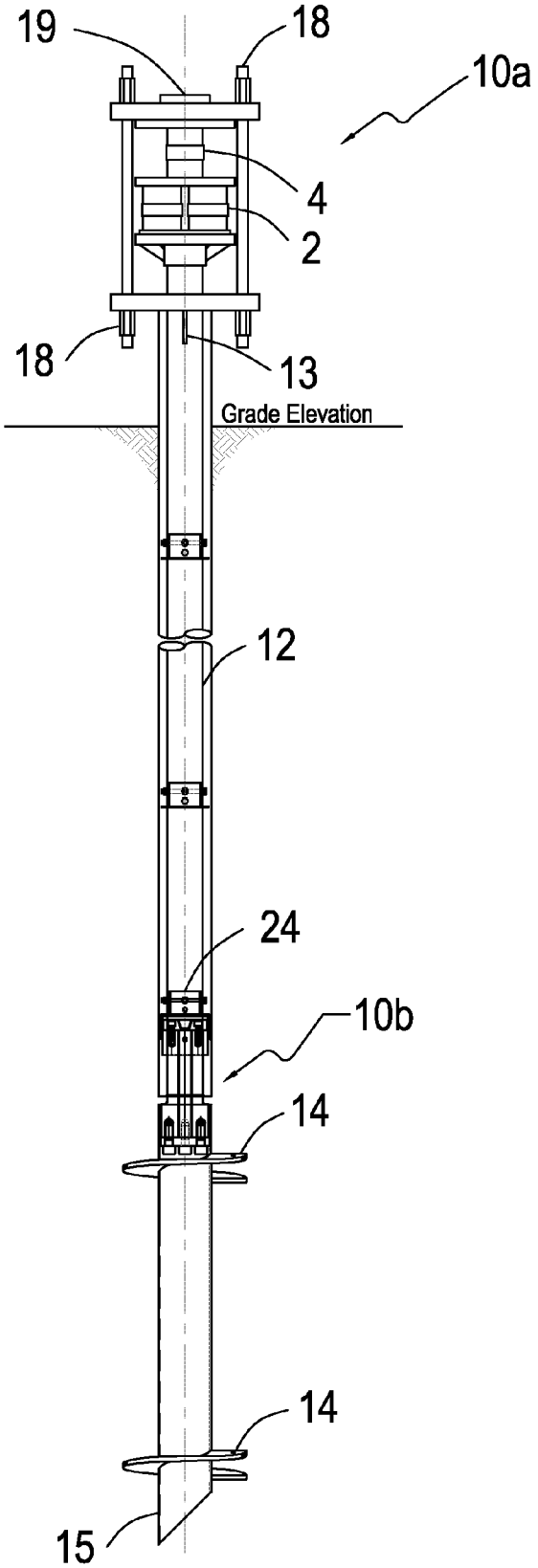
FIG. 4 is a side view of the helical test pile of the present system according to embodiments herein where the test pile comprises more than one helix.

The pile-driving assembly 10*a* will now be described in more detail having regard to FIGS. 1 and 3.

The present test pile 12 may comprise a hollow, or partially hollow central shaft having an upper (surface) 13 end and a lower ("toe" or "lead") end 15. As would be known, a substantial portion of the pile 12 shaft may penetrate the soil to be tested, with a smaller portion of the pile 12 shaft exposed aboveground (e.g. upper end 13). Pile 12 may be any desired diameter and length, and may be constructed from any appropriate material, as would be appreciated by a person skilled in the art. The pile 12 may be constructed from galvanized steel. Further, lower end 15 of the pile 12 may be configured in any manner to facilitate rotational penetration into the soil. For example, lower end 15 may be conical in shape, or any other such appropriate shape for penetrating the soil. Each test pile 12 may comprise one or more helical or load-bearing plates 14 affixed at or near the lower end 15 of the pile shaft. It is appreciated that any size, shape or number of helical plates 14 may be positioned in longitudinal spaced relation along the shaft.

As above, the pile-driving assembly 10*a* comprises load-cell 4 for imparting bi-directional loads. Load-generating device 2 and load cell 4 may be positioned within a hanging system, or housing, comprising upper and lower plates 16,17, respectively positioned above and below the assembly 10*a*, and connected together via adjustable connection means, such as a plurality of threaded nut and bolt assemblies 18. Housing elements 16,17,18 may be operatively connected to the pile 12 so as to impart forces from the load cell 4 to the pile 12. It is an aspect of the present system that components of the pile-driving assembly 10*a* may be pre-assembled, or assembled on site, at least in part due to the adjustability of the housing elements 16,17,18. Housing may further comprise spacer 19 mounted to upper plate 16 to absorb movement of upper plate 16 as it contacts cross bar "C" of the reaction system. Spacer 19 may be manufactured from any applicable impact-absorbing material, such as rubber or foam. According to embodiments herein, the hanging system containing the pile-driving assembly 10*a* may be suspended from the cross bar "C", enabling axial movement of the pile 12 within the soil.

In operation, as the load-generating device 2 causes load cell 4 to generate bi-directional force which initially pushes upper plate 16 upwardly, raising housing towards cross beam "C". Via nut/bolt assemblies 18, upper plate 16 pulls lower plate 17, which is operatively connected to upper end 13 of the pile 12, upwardly to convey the tensile forces to the pile 12 and to pull it from the ground. The "pull" is resisted by the peripheral surface of the pile 12. The pile 12 may continue to move upwardly until spacer 19 contacts cross beam "C" and causes cross beam "C" to be pushed upwardly. As would be known, the upward movement of cross beam "C" is resisted by the at least two reaction piles "R" and can be measured to determine the skin friction of the pile 12.

As would be understood that the at least two reaction piles "R" may or may not also be helical piles having at least one helical plate, and are each driven into the soil to be tested to a predetermined depth and a predetermined distance from the test pile 12. Cross beam "C" may be fixedly mounted at each end onto the reaction piles "R", provided that reaction piles "R" having sufficient strength to endure and/or withstand axial tensile forces and bending movement resulting from the load test.

As operation continues (i.e. at the same time as the load-generating device 2 causes load cell 4 to generate tensile forces), the bi-directional load cell 4 also generates equal and opposed compressive force (i.e. downwardly to the subsurface load-testing assembly 10*b*) on the pile 12. More specifically, as skin friction is being mobilized, the drive assembly 10*a* continues the load test by applying compressive force to the load-testing assembly 10*b* below ground to measure the end-bearing capacity of the pile 12. The load-testing assembly 10*b* will now be described in more detail having regard to FIGS. 2 and 4.

It is an aspect of the present system 100 that the load-testing assembly 10*b* is instrumented into, and integral with, the shaft of the helical pile 12, such that when the pile 12 is removed from the ground, the load-testing assembly 10 may subsequently be replaced or reused, minimizing costs associated with prior art systems where, for example, testing components are sacrificed with each use). Broadly speaking, the present load-testing assembly 10*b* comprises a load-transferring system having a Kelly-bar and hub type apparatus integral to the shaft of the pile 12 (described in more detail below).

More specifically, the present load-testing assembly 10*b* may generally comprise an inner load-transferring pipe 22 telescopically positioned within the outer helical test pile 12 and operative to receive compressive forces from the load cell 4. In embodiments herein, one or more load-transferring pipes 22 having an upper end 23 and a lower end 25 may be slidably received within, and coaxially aligned with, the shaft of the test pile 12. Each upper and lower end 23,25 of pipe 22 may be adapted to be connected end-to-end to additional piping 22 thereabove or therebelow, enabling the load-transferring pipe 22 to be any desired length within the pile 12. In embodiments herein, one or more load-testing pipe 22 may be directly connected end-to-end, or alternatively may be connected together via spacers. Compression forces imposed upon the load-transferring pipe 22 can cause the pile 12 to penetrate deeper into the soil.

Figure 5:
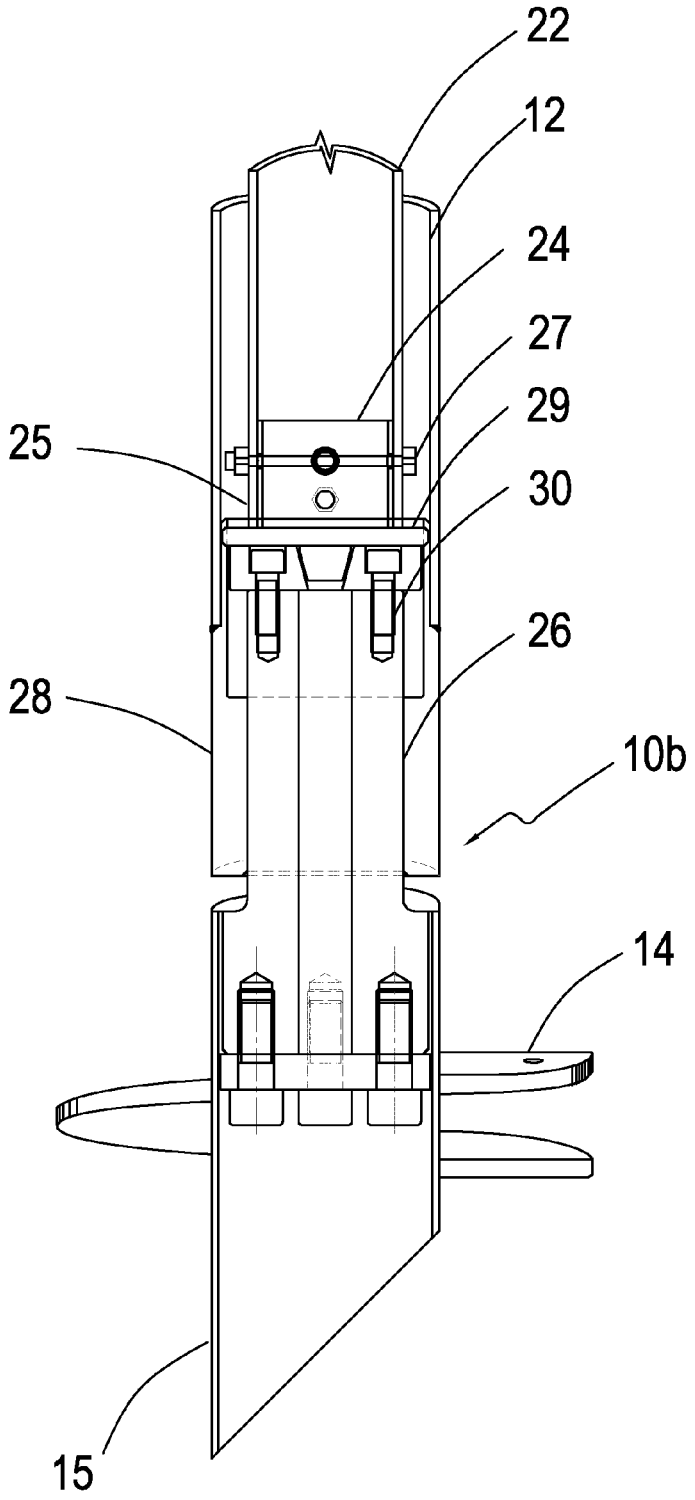
FIG. 5 is a zoomed in side view of the subsurface portion of the helical test pile of the present system according to embodiments herein.

Having regard to FIG. 5, the lower ends 15,25, respectively, of the pile 12 and pipe 22 may be configured to provide an inner "Kelly-bar" 26 and corresponding "hub" arrangement 28, whereby in response to compressive forces from the load cell 4, the Kelly-bar 26 may rotate with while telescopically extending within a tubular hub 28. The extension between the Kelly-bar 26 relative to the hub 28 can be measured and may be determinative of the end-bearing capacity of the pile 12. It is an aspect of the present system 100 that such a configuration may be used to determine the end-bearing capacity of the full diameter of the pile 12, rather than just the tip of the "toe" end.

Figure 6A:
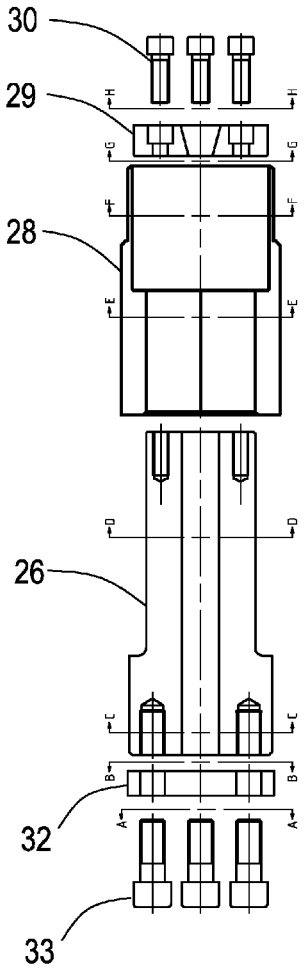
FIG. 6A is an exploded side view of the Kelly-bar and hub assembly of the present system according to embodiments herein.
Figure 6B:
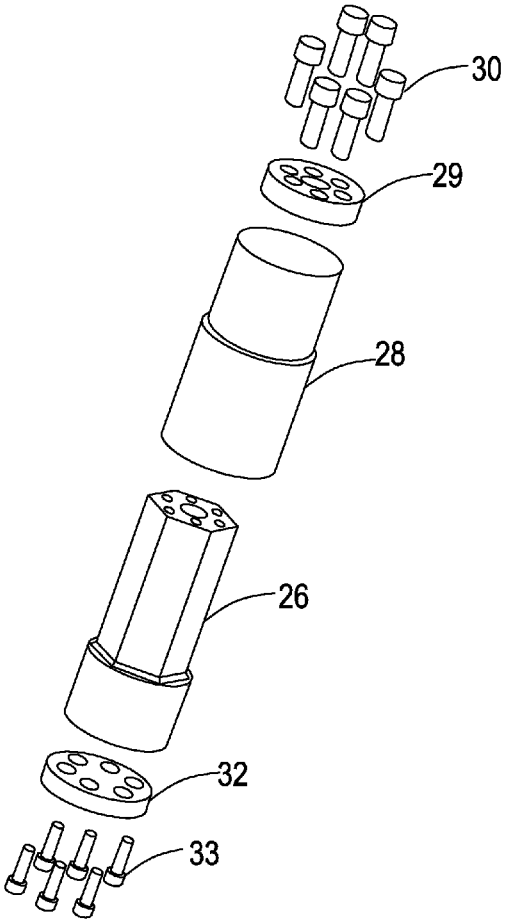
FIG. 6B is an exploded perspective view of the Kelly-bar and hub assembly of the present system according to embodiments herein.

Having regard to FIGS. 6A and 6B, the lower end 25 of the load-testing assembly 10*b*, will now be described. In embodiments herein, lower end 25 of load-transferring pipe 22 may be configured to support the mounting of a tubular "Kelly-Bar" 26 shaft affixed to the lower end 25. More specifically, lower end 25 of load-transferring pipe 22 may comprise cylindrical cap 24 for lower end 25, cap 24 being integral to the pipe 22 or secured in place by other securing means such as by at least one nut and bolt assembly 27. Cap 24 may provide connection means for connecting Kelly-bar 26 thereto. It should be understood that any connection means for securing the Kelly-bar 26 to the pipe 22 may be used. In one embodiment, cap 24 may provide an upper limiting plate 29, the plate 29 having a diameter substantially larger than the pipe 22 and smaller than the pile 12, and forming apertures therethrough for receiving threaded screws 30. During assembly of the load-testing assembly 10*b*, cap 24 and plate 29 may be positioned within the lower end 25 of the load-transferring pipe 22 such that plate 29 seals the opening of pipe 22 and is slidably received within the pile 12. Kelly-bar 26 may be secured to plate 29 via threaded screws 30, or any other means such that when the pipe 22 moves in response compressive forces from the load cell 4, the movement is transmitted from the pipe 22 to the Kelly-bar 26.

As above, the Kelly-bar 26 is in telescopic arrangement with hub 28, such that Kelly-bar 26 extends in response to compressive forces. Hub 28 may comprise a tubular component having a diameter substantially similar to the diameter of pile 12. The diameter of hub 28 may correspond to that of the pile shaft, and hub 28 may be securely affixed to the lower end 15 of the shaft. Preferably, hub 28 is welded directly to the lower end 15 of the shaft. The diameter of kelly-bar 26 may be slightly less than the diameter of tubular hub 28, such that Kelly-bar 26 may be slidably received within hub 28. As would be understood, the inner surface of the hub 28 may be configured to substantially correspond with the external surface of the Kelly-bar 26, such that torqueing of the Kelly-bar 26 imparts rotational movement to the hub 28.

It is an aspect of the present load-testing assembly 10*b* that Kelly-bar 26 be configured so as to withstand the rotational torque required to install the helical test pile 12. In one embodiment, Kelly-bar 26 may comprise a hexagonal cross-sectional profile, as depicted in FIG. 6B. Kelly-bar 26 may further comprise a lower portion, extending below hub 28, comprising a substantially larger cross section. Lower portion of Kelly-bar 26 may comprise a diameter similar or substantially similar to the pile 12, providing the lower portion of the Kelly-bar 26 forms a continuation of the shaft of the pile 12. Lower portion of Kelly-bar 26 have a substantially circular cross-section. It is an aspect of the present technology that such a configuration may enable the end-bearing capacity of the entire pile 12 to be determined, rather than just the "toe" end of the pile 12.

Figure 7:
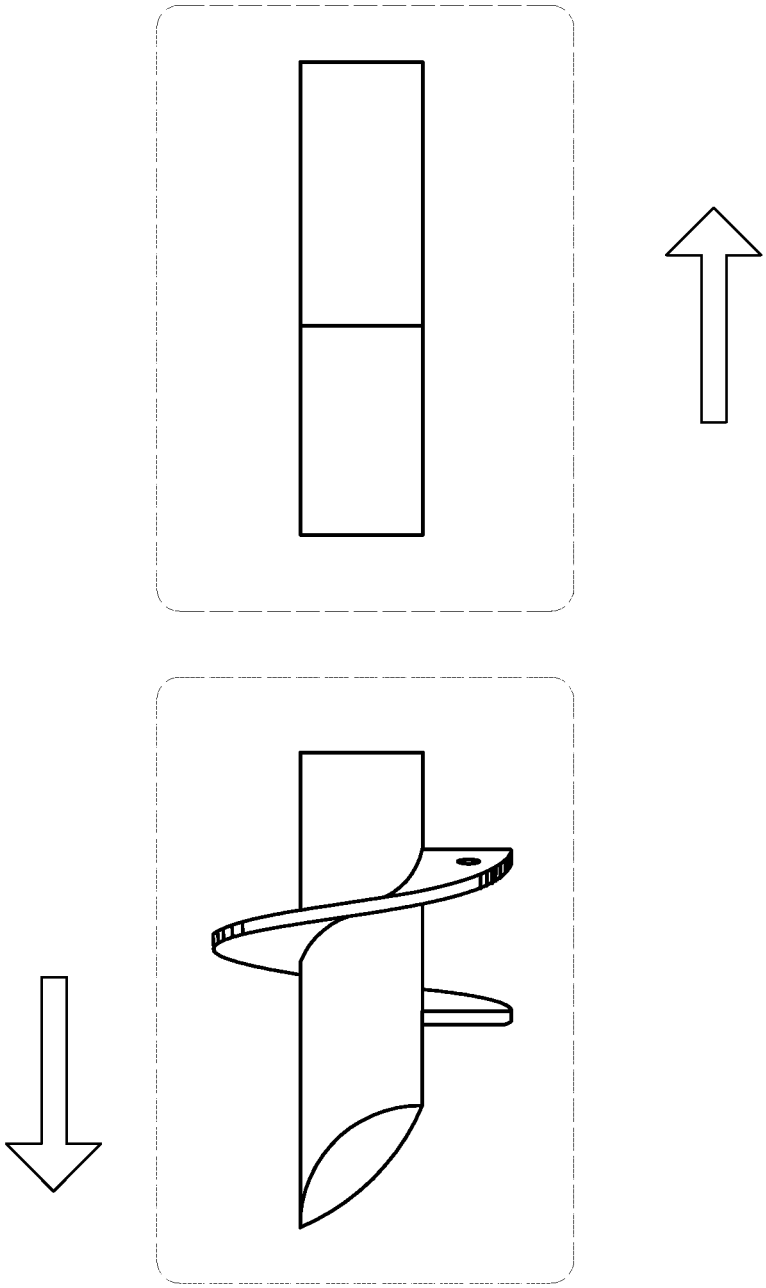
FIG. 7 is a representative illustration of the movement between the telescoping Kelly-bar (downwardly) and the hub/pile shaft (upwardly) of the present system according to embodiments herein.

Having regard to FIG. 7, in operation, as downward load is applied to the load-transferring pipe 22, the pipe 22 slidably telescopes downwardly within the pile 12 (being pulled upwardly), the pipe 22 causing the Kelly-bar 26 to telescopically extend from hub 28, the extension being resisted by the surrounding soil. Movement of the Kelly-bar 26 may be measured to determine the end-bearing capacity of the pile 12.

According to embodiments herein, the present system 100 may be used to test the load capacity of helical piles 12 having a plurality of helical plates 14. It is contemplated that the plates 14 may be positioned on the shaft of the pile 12 and/or the lower portion of the Kelly-bar 26. The present system 100 may allow for the load testing of a helical pile 12 by instrumenting a load-testing system within the pile, whether the system is positioned above, below, or in between the helical plates 14.

Helical plates 14 may be affixed to the lower end 15 of the pile 12, and preferably at least one of the helical plates 14 may be positioned along the lower portion of Kelly-bar 26. It is understood that one or more helical plates 14 may be positioned longitudinally along the outer surface of the pile 12 and that the length of the pile 12 may be any such length desired to support helical plates 14. It is contemplated that one or more helical plates 14 may be spaced longitudinally along Kelly-bar 26, and that the length of Kelly-bar 26 may be any such length desired to support helical plates 14.

Having regard to the Kelly-bar 26, in embodiments herein, Kelly-bar 26 may comprise lower limiting plate 32, the plate 32 having a diameter similar or substantially similar to Kelly-bar 26 and a plurality of radial apertures for receiving threaded screws 33. Accordingly, the design of the present system provides a helical pile having an instrumented load-testing system integral therewith without limiting the strength of the pile shaft or its ability to withstand the rotational forces required to drive the pile into the ground.

Embodiments of the present system 100 will now be described with reference to the following examples.

Example

Figure 8:
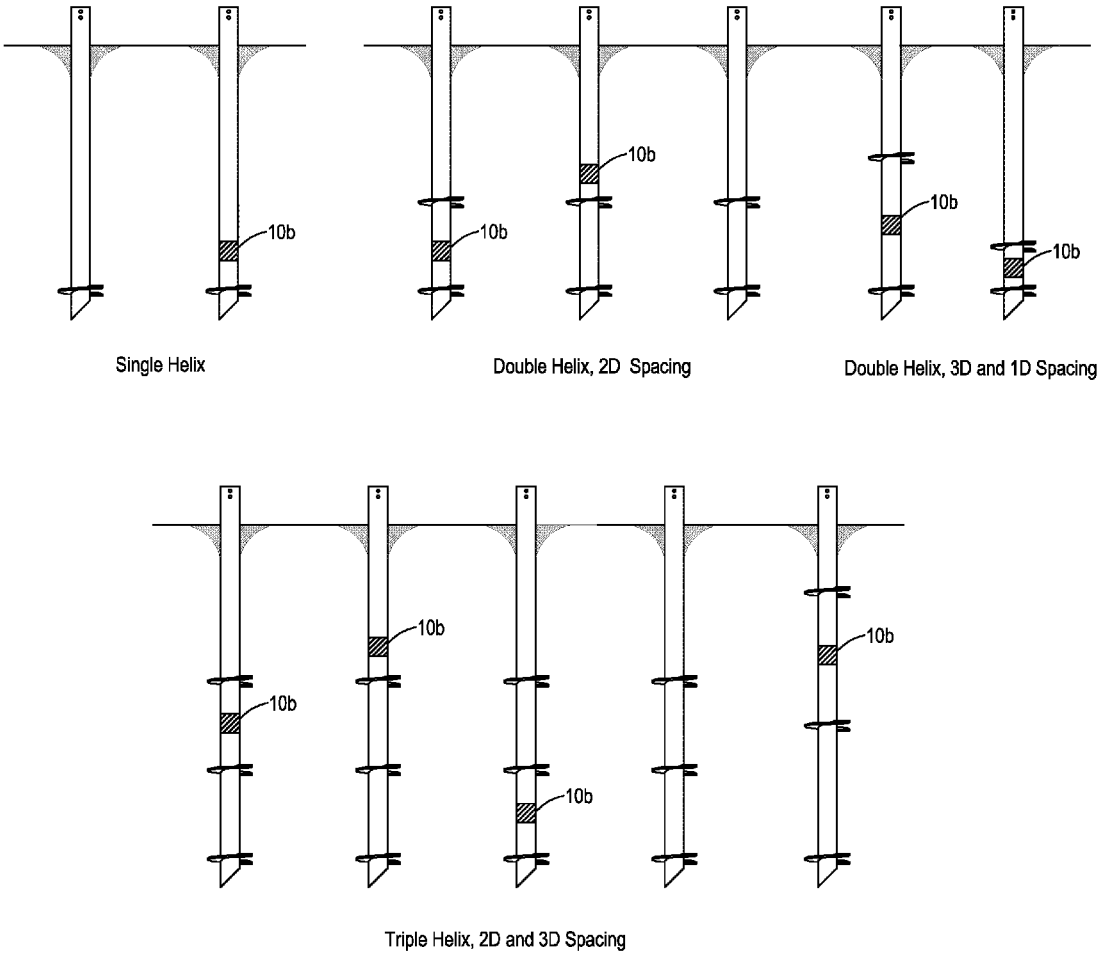
FIG. 8 provides example configurations of the present system 100 according to embodiments herein.

By way of example, having regard to FIG. 8, an individual test to determine the load capacity of a helical pile 12 using the present system 100 may commence by first installing a helical test pile 12 instrumented with the present Kelly-bar 26 and hub 28 configuration. Helical pile 12 may have one or more helical plates positioned above, below or above and below the Kelly-bar 26. Helical pile 12 may be installed into the ground using a torque machine. It is contemplated that the Kelly-bar 26 and hub 28 assembly are designed to first withstand the torque required to install (and rotate) the helical pile 12 into the ground, and second to enable measurement of the end-bearing capacity of the pile 12, whether the helical plates 14 are above, below or above and below the Kelly-bar 26. Once in position, load-transferring pipe 22 can be pre-assembled or assembled on site, such that it may be slidably received with the helical pile 12 already installed in the ground. Drive assembly 10*a* can then be assembled and installed to the upper end 13 of the pile 12, and the reaction system operatively engaged to the pile 12, above the ground surface.

The load test can begin with the activation of hydraulic jack 2 to impart bidirectional expansion of the load cell 4 to impart bidirectional expansion of the cell 4. Initially, tensile forces imparting on the pile 12 cause the pile to pull upwardly out of the ground until upper cap plate 16 (and spacer 19) of housing reaches the cross beam "C" of the reaction system. Beam "C" is pushed upwardly for a predetermined distance (e.g. approximately one inch) until movement of the cross beam "C" transfers to the anchored reaction piles "R", preventing further movement of beam "C". At this point, the peripheral resistance or "skin friction" of the pile 12 can be considered to be fully mobilized and can be measured.

Next, (albeit simultaneously), the hydraulic jack 2 and load cell 4 imparts compressive force on the load-transferring pipe 22, causing downward movement of the pipe 22 and thus of Kelly-bar 26, causing Kelly-bar 26 to extend from hub 28 into the soil below the pile 12. Displacement of the Kelly-bar 26 from hub 24 creates a gap therebetween, and enables measurement of the end-bearing capacity of the pile 12 and specifically of the at least one helical plates 14 affixed thereto. It would be understood that in order for the compressive load to push pile 12 downwardly, the required capacity of the reaction system must be greater than the end-bearing capacity of the pile 12, said reaction system capacity being calculated as: skin friction+total uplift capacity of the two reaction piles+self-weight of the reaction system.

By way of example, the present system 100 may provide for the pile capacity ($Q_{total}$) from the skin friction of the shaft ($Q_{shaft}$)+the end-bearing capacity ($Q_{end}$), where $Q_{shaft}=A_{shaft}\times f_s$ (unit skin friction), and where $Q_{end}$ is $A_{helix}\times$ qb (end-bearing pressure).

After testing is complete, the entire drive assembly 10*a* may be disassembled and removed for reuse.

While particular embodiments have been shown and described in the present Detailed Description, it is understood that changes and modifications can be made without departing from the present invention and the claims below.

We claim:

1. An apparatus for testing the load capacity of a helical pile positioned in soil, the helical pile being operably connected to a reaction system having a cross beam and at least two reaction piles positioned in the soil adjacent to the helical pile, the apparatus comprising:

a bi-directional load-generating device, positioned above the surface of the soil, for simultaneously generating tensile and compressive load on the helical pile, the helical pile, having a shaft with an upper end and a lower end, at least one load-transferring pipe, positioned within the pile shaft, the load-transferring pipe having an upper end and a lower end, the lower ends of the helical pile and the load-transferring pipe configured to provide a hub and Kelly-bar arrangement positioned below the surface of the soil, wherein the tensile and compressive loads impart simultaneous upward forces to the pile and downward forces to the load-transferring pipe for determining the shaft resistance and end-bearing capacity of the pile.

2. The apparatus of claim 1, wherein the bi-directional load-generating device is positioned within an adjustable housing operably connected to the reaction system.

3. The apparatus of claim 1, wherein the hub is affixed to the helical pile.

4. The apparatus of claim 1, wherein the Kelly-bar is connected to the load-transferring pipe.

5. The apparatus of claim 1, wherein the helical pile comprises at least one helical plate.

6. The apparatus of claim 1, wherein the helical pile comprises a plurality of helical plates positioned above, below, or above and below the Kelly-bar and hub arrangement.

7. The apparatus of claim 1, wherein the lower end of the helical pile is conical.

8. The apparatus of claim 1, wherein the load-generating device comprises a hydraulic jack and pressurized load cell.

9. A method, comprising:

using the apparatus of claim 1 for simultaneously measuring the shaft resistance and the end-bearing capacity of the helical pile.

10. A method of testing the load capacity of a helical pile positioned in the soil, the pile being operatively connected to a pile reaction system, the method comprising:

providing a helical pile, having at least one helical plate, the pile comprising an inner load-transferring pipe telescopically received within an outer pile shaft, the lower end of the load-transferring pipe and pile adapted to provide a Kelly-bar coupled to a tubular hub below the surface of the soil, providing a load-generating device above the surface of the soil for producing a tensile load on the pile and a compressive load on the load-transferring pipe, and measuring the pile resistance and end-bearing capacity of the pile.

11. The method of claim 10, wherein the helical pile comprises at least two helical plates.

12. The method of claim 10, wherein the helical pile comprises two or more helical plates.

13. The method of claim 10, wherein the end-bearing capacity is detected by measuring the telescopic movement of the load-transferring pipe from the outer pile shaft.

* * * * *